US008033428B1

(12) United States Patent
McEwin

(10) Patent No.: US 8,033,428 B1
(45) Date of Patent: Oct. 11, 2011

(54) TOOTHPASTE DISPENSER DEVICE

(76) Inventor: Ben McEwin, Tempe, AZ (US)

( * ) Notice: Subject to any disclaimer, the term of this patent is extended or adjusted under 35 U.S.C. 154(b) by 151 days.

(21) Appl. No.: 12/426,063

(22) Filed: Apr. 17, 2009

(51) Int. Cl.
*B65D 35/28* (2006.01)

(52) U.S. Cl. ..... 222/93; 222/95; 222/39; 222/103

(58) Field of Classification Search ..... 222/103, 222/39, 105, 93, 95
See application file for complete search history.

(56) References Cited

U.S. PATENT DOCUMENTS

| | | | | | |
|---|---|---|---|---|---|
| 859,711 | A * | 7/1907 | Winsor | 132/114 |
| 1,212,138 | A * | 1/1917 | Glasow et al. | 222/93 |
| 1,853,652 | A * | 4/1932 | Allinson | 222/103 |
| 2,053,697 | A * | 9/1936 | Harilaos et al. | 222/103 |
| 2,340,681 | A * | 2/1944 | Oursler | 222/96 |
| 2,390,314 | A * | 12/1945 | Massey | 222/103 |
| 3,155,278 | A * | 11/1964 | Le Baron | 222/93 |
| 3,203,596 | A * | 8/1965 | Davidson | 222/103 |
| 3,281,016 | A * | 10/1966 | Thompson et al. | 222/103 |
| 3,313,455 | A * | 4/1967 | Kemmer | 222/103 |
| 3,536,234 | A * | 10/1970 | Rise | 222/103 |
| 3,675,822 | A * | 7/1972 | Casali et al. | 222/103 |
| 3,893,590 | A * | 7/1975 | Paroussiadis | 222/103 |
| 4,576,314 | A * | 3/1986 | Elias et al. | 222/97 |
| 5,323,932 | A * | 6/1994 | Bauman | 222/96 |
| 5,920,967 | A * | 7/1999 | Souza | 24/563 |
| 6,302,298 | B1 * | 10/2001 | Chernov et al. | 222/103 |
| 6,557,728 | B1 * | 5/2003 | Anderson et al. | 222/39 |
| 6,669,055 | B1 * | 12/2003 | Coleman et al. | 222/103 |
| 2004/0094570 | A1 * | 5/2004 | Ho | 222/39 |
| 2006/0043108 | A1 * | 3/2006 | Burrell | 222/103 |
| 2007/0194044 | A1 * | 8/2007 | Chernov et al. | 222/103 |

* cited by examiner

*Primary Examiner* — Frederick C Nicolas
*Assistant Examiner* — Donnell Long
(74) *Attorney, Agent, or Firm* — Schmeiser, Olsen & Watts LLP

(57) ABSTRACT

An apparatus and method for dispensing toothpaste is disclosed herein whereby a user may depress a depressor to extract a pre-determined quantity of toothpaste from a tube of toothpaste. The present invention includes a toothpaste dispenser body forming a radius resiliently and integrally securing together a substantially flat first coextensive member and a substantially flat second coextensive member. The second coextensive member may comprise a downward first curvature towards the first coextensive member and an upward second curvature away from the first coextensive member. The second coextensive member comprises a depressor comprising resilient material. The radius may be used to contain and roll the portion of the toothpaste tube that has been evacuated of toothpaste, thereby allowing the second coextensive member to remain in contact with the filled portion of the toothpaste tube.

14 Claims, 5 Drawing Sheets

TOOTHPASTE DISPENSER DEVICE

BACKGROUND OF THE INVENTION

1. Technical Field

The present invention relates generally to the field of dispensing and more specifically relates to the regulated dispensing of toothpaste from a tube.

2. Background Art

Toothpaste is a paste or gel dentifrice used to clean and maintain the aesthetics and health of teeth. Toothpaste is used to promote oral hygiene by removing dental plaque and food from the teeth. Toothpaste is used by most individuals on a daily basis to clean and protect teeth from damage. Toothpaste is commonly sold in flexible tubes or rigid containers. Flexible tubes may be squeezed to extract toothpaste onto a toothbrush. The rigid container type is designed to stand upright to save shelf space. In these versions of containment, toothpaste may be frequently wasted due to dispensing a larger amount than required as well as the inability to completely deplete toothpaste from the containers using present manual and automatic dispensing methods.

Tubes have a tendency to not fully prevent backward flow of the toothpaste; therefore the task of completely removing all contents from the tube may be a difficult one, especially at the front of the tube. Further, toothpaste tubes may become germ infested if not stored up and away from unclean surfaces found in bathrooms. Problems such as waste may also be encountered, especially when children are left to dispense toothpaste onto a brush. Examples of attempts to solve the mentioned problems may be found in U.S. Pat. Nos. 5,501,369 and 5,897,030.

Automatic toothpaste dispensers or toothpaste pumps are devices that may be used to contain and dispense toothpaste, similar to a tube. Unlike a tube, they are made of rigid plastic and function by pressing a knob on the top rather than squeezing the tube. These dispensers may allow toothpaste to dry and are difficult to keep clean. Further, because of the pumping action used it is difficult to get an accurate amount of toothpaste onto the toothbrush to avoid wasting the product.

Many times it is difficult to get children to consistently brush their teeth at multiple intervals during the day. Present alternatives may not provide entertaining gratification for youngsters to entice them to remember to brush their teeth. Toothpaste dispensers may be awkward to use and may require two hands to operate.

Ideally, a toothpaste dispenser should be user-friendly, fun to use, operate reliably to fully dispense toothpaste contents and be manufactured at a modest expense. Thus, a need exists for a toothpaste dispenser that is operated with a single hand to avoid the above-mentioned problems.

BRIEF SUMMARY OF THE INVENTION

The present invention holds significant improvements and serves as a toothpaste dispensing device comprising: a toothpaste dispenser body forming a radius resiliently and integrally securing together a substantially flat first coextensive member and a substantially flat second coextensive member. The second coextensive member may comprise a downward first curvature towards the first coextensive member and an upward second curvature away from the first coextensive member. The second coextensive member comprises a depressor comprising resilient material. The radius may be used to contain and roll the portion of the toothpaste tube that has been evacuated of toothpaste, thereby allowing the second coextensive member to remain in contact with the filled portion of the toothpaste tube.

The toothpaste dispenser may be designed in the form of a friendly, aesthetically pleasing caricature to help remind children to brush. There are toothbrush holder slots; a toothpaste tube holder, wherein the toothpaste tube holder comprises a concave indentation means to cradle the toothpaste tube; and a stopper to create a physical stop between the coextensive members. As a result the depressor has only a limited travel distance, allowing only a pre-determined volume of toothpaste to be dispensed. Toothpaste dispenser further comprises friction surface(s), which may comprise backwardly facing teeth or other gripping means located on the underside of the second coextensive member to secure the toothpaste tube in place. The system may also comprise a sound generator, which may be used to create audible sound(s) in response to an occurrence when the depressor is depressed against the toothpaste tube. The toothpaste dispensing system is operable using one hand to dispense toothpaste from the toothpaste tube.

A toothpaste tube holder comprises a concave indentation means to cradle the toothpaste tube and may be in the shape of a tongue and may comprise gripping means. The toothpaste tube holder may comprise an angle of inclination relative to the first coextensive member to prevent the toothpaste tube from contacting the first coextensive member to substantially eliminate the tooth paste tube from contacting unclean surfaces. After use the cap may be replaced on the toothpaste tube to cover the orifice, thereby substantially preventing drying of the toothpaste. The toothpaste dispensing system may comprise a kit comprising: a toothpaste dispenser; a toothbrush; a toothpaste tube; and a set of user instructions.

A method of use of a toothpaste dispensing system is disclosed herein comprising the steps of: pressing the depressor to extract a pre-determined amount of toothpaste from the toothpaste tube located in the toothpaste dispenser using one hand; and repositioning the toothpaste tube for the next use. The method may be expanded to further comprise the steps of: inserting the toothpaste tube into the toothpaste dispenser on the toothpaste tube holder; and pressing the depressor to extract a pre-determined amount of toothpaste from the toothpaste tube located in the toothpaste dispenser using one hand. The act of pressing the depressor may activate the sound generator to release an audible signal when the depressor is depressed against the toothpaste tube. The method may include using extracted toothpaste to brush teeth of a user and then repositioning the toothpaste tube for the next use. The toothpaste tube is in contact with gripping means located on the underside of the second coextensive member and ultimately the cap to cover the orifice is replaced on the tube, thereby substantially preventing drying of the toothpaste.

BRIEF DESCRIPTION OF THE DRAWINGS

The preferred embodiments of the present invention will hereinafter be described in conjunction with the appended drawings, wherein like designations denote like elements.

DETAILED DESCRIPTION

Figure 1:
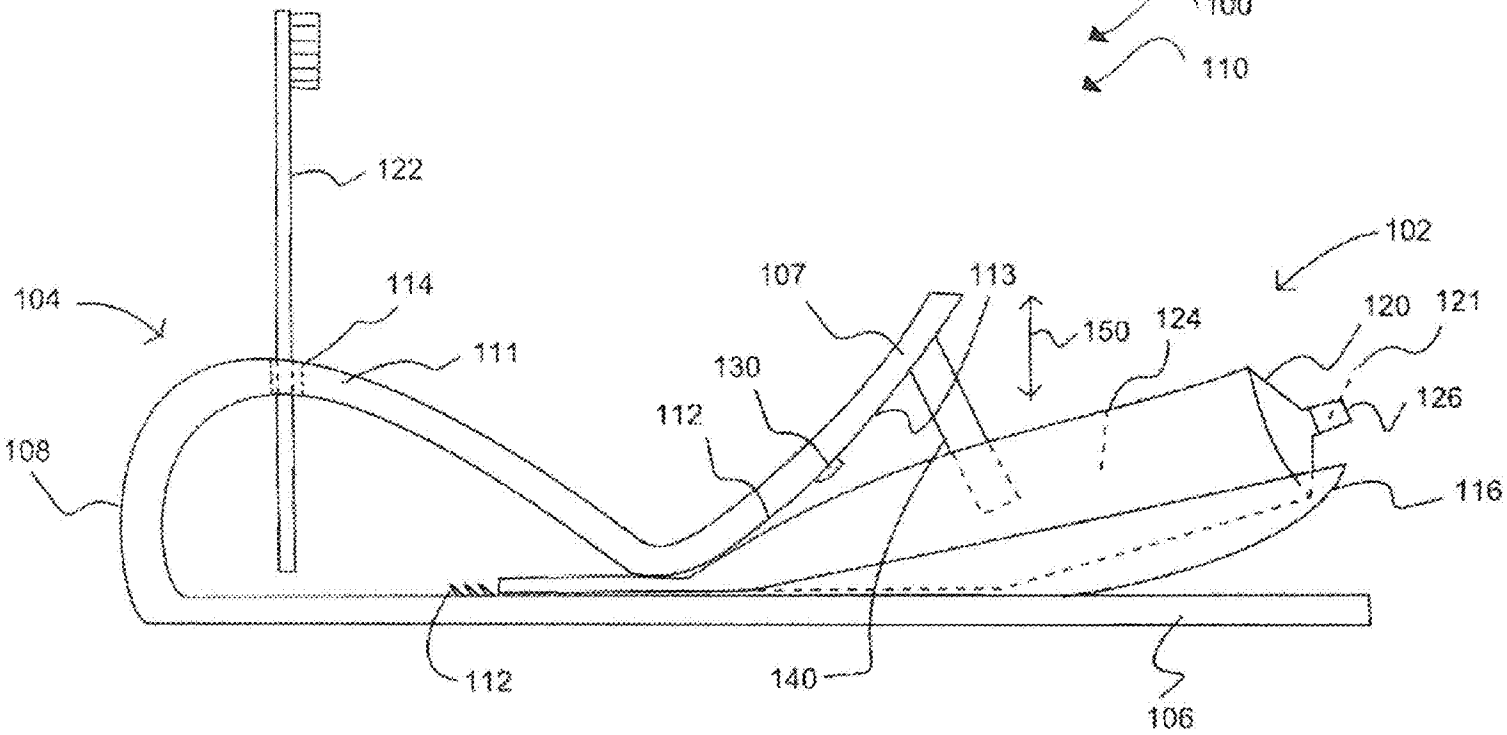
FIG. 1 shows a perspective side view, illustrating a toothpaste dispensing device of a toothpaste dispensing system, in accordance with the present invention.

Referring now to FIG. 1, showing a perspective side view, illustrating toothpaste dispensing device 110 of toothpaste dispensing system 100, according to a preferred embodiment of the present invention.

Toothpaste dispensing device 110 comprises a resilient, substantially rigid member including toothpaste dispenser body 111, a depressor 113, a friction surface 112, a stopper 140, and a toothpaste tube holder 116. Toothpaste dispenser body 111 forms a radius 108 resiliently and integrally securing together a substantially flat first coextensive member 106 and a substantially flat second coextensive member 107. Second coextensive member 107 comprises a downward first curvature towards first coextensive member 106 and an upward second curvature up and away from first coextensive member 106, as shown.

Toothpaste dispensing device 110 comprises plastic, bamboo, or metal material. Radius 108 is used to contain and aid in the process of rolling portion of toothpaste tube 120 that has been evacuated of toothpaste 124, thereby allowing second coextensive member 107 to remain in contact with filled portion of toothpaste tube 120. It should be noted that, under appropriate circumstances, when considering such issues as user, design, and marketing preferences, cost considerations, structural requirements, available materials, technological advances, and the like, other materials may be used such as, for example, various alloys, composites, various types of plastics, glass, ceramic, and the like, may present suitable alternatives.

Figure 2:
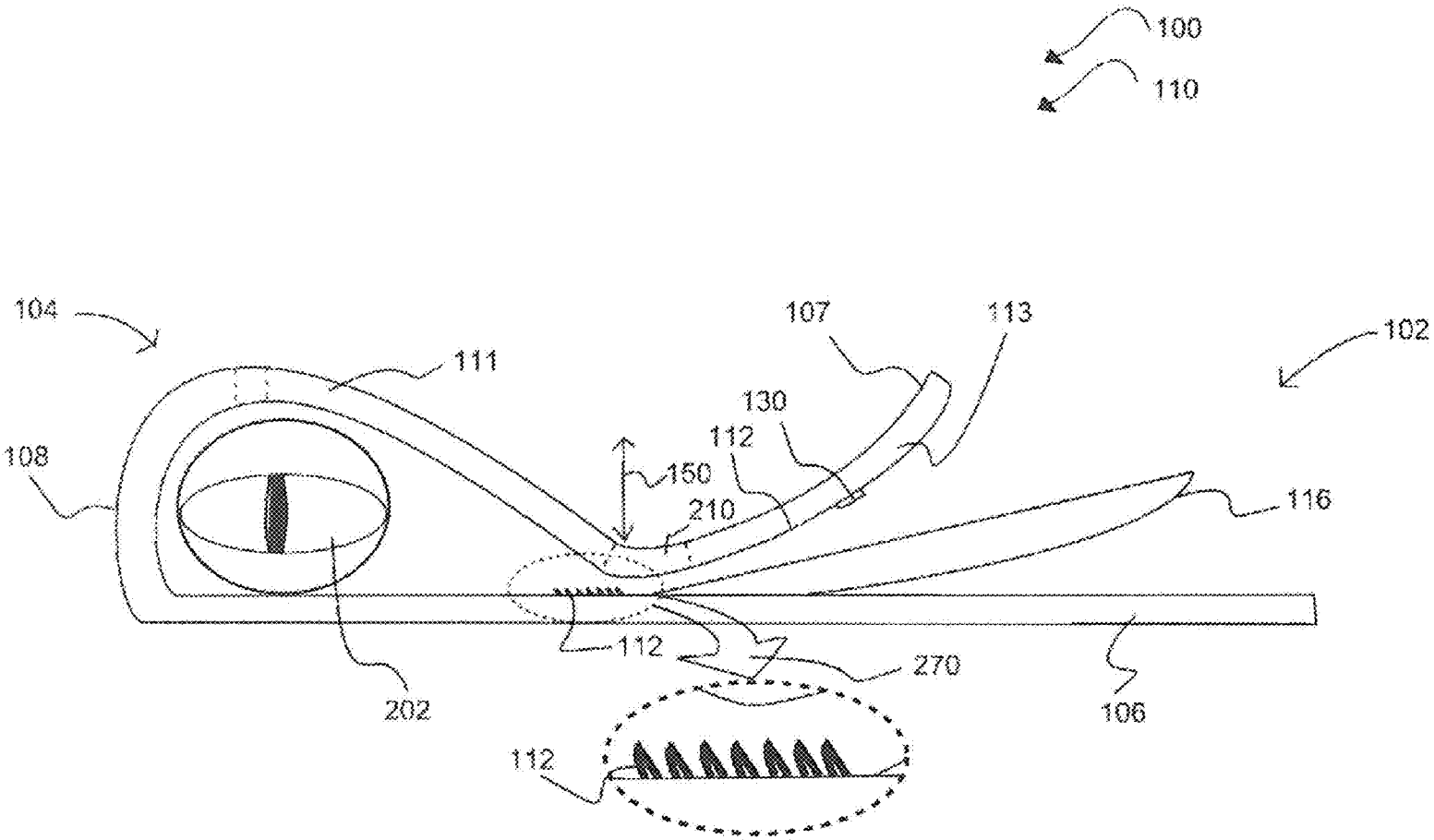
FIG. 2 is a perspective side view, illustrating the toothpaste dispensing device of a toothpaste dispensing system, in accordance with the present invention.
Figure 3:
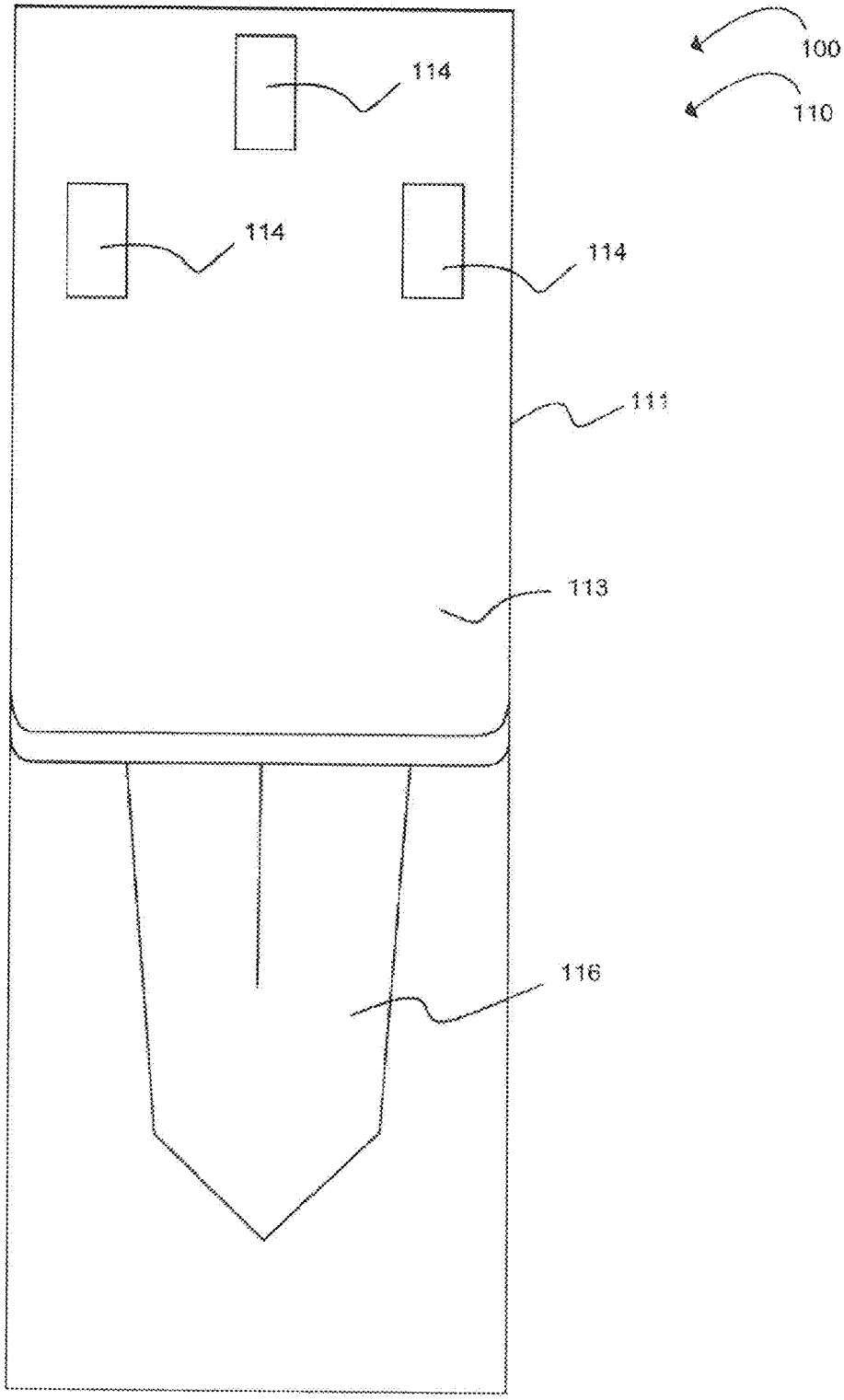
FIG. 3 is a perspective top view, illustrating the toothpaste dispensing device of a toothpaste dispensing system, in accordance with the present invention.
Figure 4:
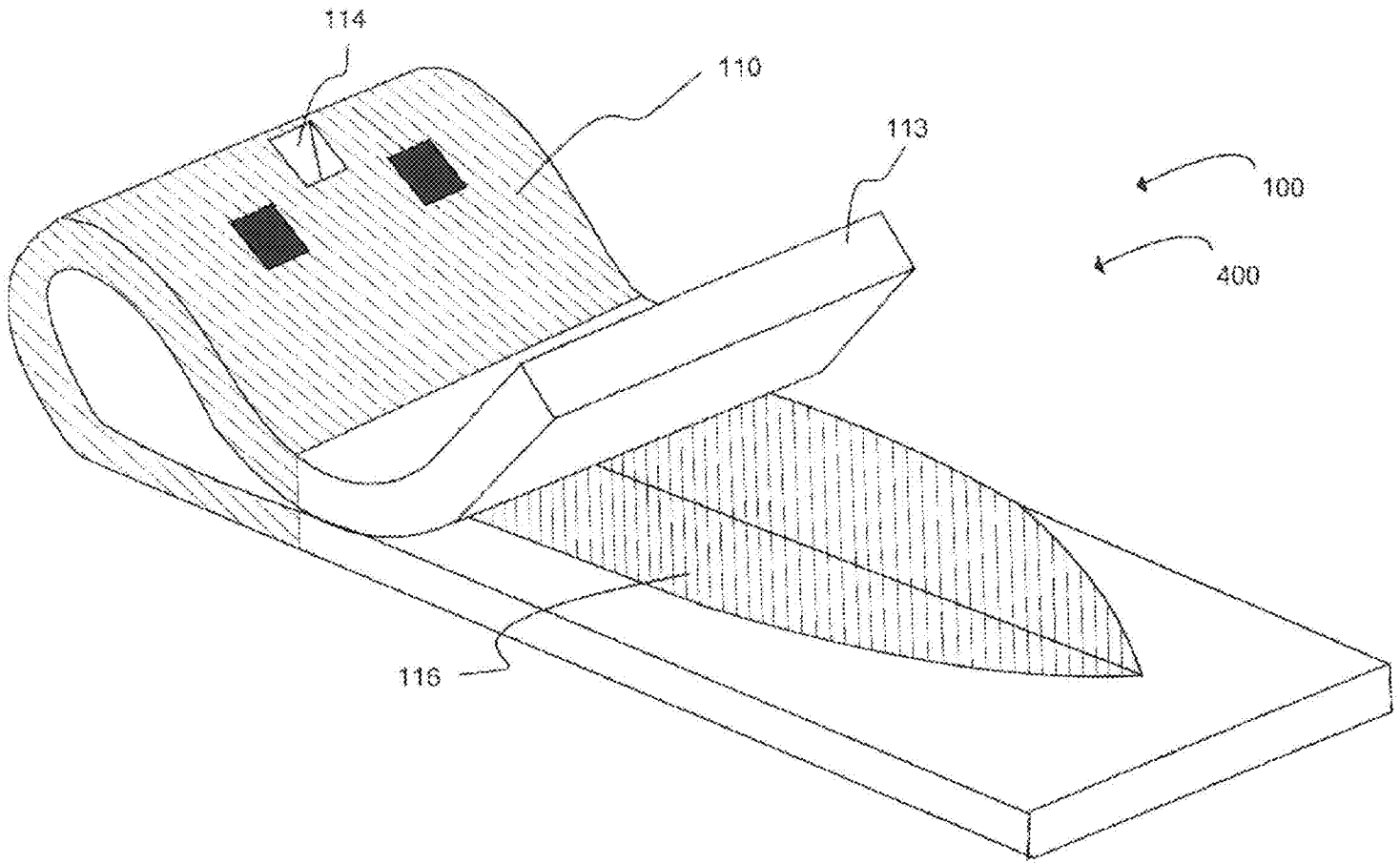
FIG. 4 is a perspective top view, illustrating a cosmetic design of the toothpaste dispensing device of a toothpaste dispensing system, in accordance with the present invention.

First coextensive member 106 comprises a longer length than second coextensive member 107, as shown in FIGS. 2-4. In particular embodiments, first coextensive member 106 and second coextensive member 107 may comprise dimensions of about 2½ inches wide, 15 inches long combined total length and comprised of ¼ inch thick material before being formed into its preferred shape about radius 108. It should be appreciated that other sizes and shapes may be suitable for the application described and that the dimensions, shape and appearance given are in no way meant to limit the invention as described and claimed herein.

Friction surface 112 comprises rearwardly facing teeth on underside of second coextensive member 107 or other suitable grips that create a friction means whereby toothpaste tube 120 may be substantially positively secured, so when a user pushes down on depressor 113, toothpaste tube 120 is held firmly in position, allowing depressor 113 to come into contact with an outer surface of toothpaste tube 120. Toothpaste 124 is extracted as depressor 113 causes the tube walls of toothpaste tube 120 to come into proximate contact with each other, reducing the available volume, thereby forcing toothpaste 124 outwardly from the depression point. Direction arrow 150 illustrates movement of depressor 113. The force pushes toothpaste 124 out of orifice 121 to be deposited on toothbrush 122. Ideally, a pre-determined, measured amount of toothpaste 124 is extracted to limit the amount of waste.

Toothpaste 124, as mentioned, is extracted in pre-determined, measured amounts. This is substantially accomplished by stopper 140. Stopper 140 is attached to or integral with the second coextensive member 107, as shown. Stopper 140 effectively creates a physical stop between first coextensive member 106 and second coextensive member 107, allowing depressor 113 only a limited travel distance, thereby allowing only a pre-determined volume of toothpaste 124 to be dispensed. This feature effectively ensures an accurate metering process and minimizes waste of toothpaste 124. Ideally, enough toothpaste 124 should be extracted to supply a bead onto about ½ of the surface area of the brush portion of toothbrush 122. Depressor 113 may be easily pushed downwardly by users of varying strengths because the present invention uses flexible material of differing tensile strengths to promote the bending movements required as well as minimizing fatigue stresses. Lower tensile strength portion 210 may be found in about a one inch portion of the curve where second coextensive member 107 substantially meets first coextensive member 106, as shown in FIG. 2. In this way depressor 113 may function as a lever.

Within another preferred embodiment of the present invention, stopper 140 and or biasing means between first coextensive member 106 and second coextensive member 107 may also comprise a spring.

First coextensive member 106 and second coextensive member 107 may be biased each other and maintain a constant compressive pressure on toothpaste tube 120 equal and opposite to the outward tension force exerted by toothpaste tube 120 so that depressor 113 essentially must be used to extract toothpaste 124. In this way cap 126 may be removed without toothpaste 124 exiting orifice 121 and cap 126 may be replaced on toothpaste tube 120, after use, to prevent drying of toothpaste 124. The toothpaste tube 120 may be then repositioned for the next use in response to replacing the cap 126 on the toothpaste tube 120. The replacing of the cap 126 applies a force to the toothpaste tube 120 and pushes it further back into the dispenser in a position ready for the next use.

Toothpaste tube holder 116 comprises a concave indentation means to cradle toothpaste tube 120, as shown. The indentation comprises a longitudinal line in a U-shape or V-shape on the upper surface providing a recess along the length of toothpaste tube holder 116, as shown in FIG. 4. Toothpaste tube holder 116 serves to hold toothpaste tube 120 at a slight angle of inclination so that proximate end 102 with orifice 121 is slightly elevated thereby providing easier, cleaner access to extract toothpaste 124 onto toothbrush 122. Distal end 104 is also shown in the present figure for clarity. Toothpaste dispenser 110 is designed to sit flat on a counter surface, in the preferred orientation as shown. A toothbrush 122 may be stored, as shown.

Referring now to FIG. 2, showing a perspective side view, illustrating toothpaste dispensing device 110 of toothpaste dispensing system 100, according to a preferred embodiment of the present invention of FIG. 1.

FIG. 2 shows toothpaste dispenser 110 without toothbrushes 122 stored in toothbrush holder slots 114. Reptile eye 202 may serve as a concealing means to camouflage the rolled up portion of toothpaste tube 120. It should be noted that reptile eye 202 as illustrated within the present embodiment, is used to explain a use which helps the present invention appear as a reptile from a side view; however other equivalent decorative features may be used to achieve the same desired result and the disclosure should not be considered to be limited to a reptile eye 202. Sound generator 130 is secured to depressor 113 on second coextensive member 107, as shown, so that an audible signal is sounded when depressor 113 is depressed against toothpaste tube 120, as discussed in FIG. 1. Sound generator 130 is shown in the present figure and is discussed in greater detail in FIG. 4. Substitution arrow 270 designates an enlarged view of friction surface 112.

Referring now to FIG. 3, showing a perspective top view, illustrating toothpaste dispensing device 110, according to a preferred embodiment of the present invention of FIG. 1.

Toothpaste dispensing device 110 may provide toothbrush 122 storage means whereby toothbrush 122 may be safely stored in a visible position for children and adults and to further serve as a reminder to brush teeth at appropriate intervals. Toothbrushes 122 are stored up-rightly, as shown in FIG. 1, so they do not take up valuable counter space and are not subjected to contact with unclean surfaces. FIG. 3 also shows an approximate ratio of first coextensive member 106 to second coextensive member 107 and the orientation of components one to another from a top perspective view.

Referring now to FIG. 4, showing a perspective top view, illustrating a cosmetic design 400 of toothpaste dispensing device 110, according to a preferred embodiment of the present invention of FIG. 1.

Novelties within the present invention are purposed to entice children to brush their teeth on a regular basis. Toothpaste 124 may come in a variety of colorings, and flavors. Flavors may include mint, anise, apricot, bubblegum, cinnamon, fennel, lavender, ginger, vanilla, lemon, orange, pine, peanut butter, iced tea, and unflavored toothpaste. The present invention is designed to be an esthetically pleasing device that makes the event of tooth brushing a fun and memorable event. Toothpaste dispenser 110 comprises an aesthetically pleasing design to attract children's attention; however it should be noted that other variations and designs may be used to achieve the same or substantially similar results. Toothpaste dispenser body 111, toothbrush holder slots 114, and toothpaste tube holder 116 are shown in the present figure, as a user would view when toothpaste dispenser 110 is set on a bathroom counter or shelf.

Toothpaste dispenser body 111 within an embodiment of the present invention comprises the markings of and resembles a mallard duck's head or other caricature, designed to garner attention and recollection of the tooth brushing event from its users. The markings comprise green paint, as shown with the diagonal hatching, to allude to a duck's head and face, a white bill, where no hatching is shown, and a pink tongue, shown in vertical line, hatching that serves as toothpaste tube holder 116. It should be noted that, under appropriate circumstances, when considering such issues as user, design, and marketing preferences, cost considerations, structural requirements, available materials, technological advances, and the like, other marking and coloring arrangements such as, for example, other cartoon characters, bright colors, dotted designs, and the like, may present a suitable alternative.

Toothbrush holder slots 114 are designed to appear as eyes (from a frontal or top-view), when toothbrush 122 is removed for use, as also shown in FIG. 3. The fun design promotes the child to return toothbrush 122 to its proper storage place after its use, as shown in FIG. 1. Toothbrush holder slots 114 are used to substantially minimize contamination of toothbrushes 122 that occur when stored on unclean counters or in vanities, where they may come into contact with such unclean surfaces. In this way toothpaste dispensing system 100 substantially serves to isolate toothbrushes 122 from contamination and thereby protects user's health.

Sound generator 130 is used to create an audible sound in response to a preset occurrence that may be heard from a distance. An occurrence such as removing or replacing toothbrush 122 from or to toothbrush holder slot 114 or when pushing depressor 113 to extract toothpaste 124 may cause sound generator 130 to be activated. In this manner, a 'fun' sounding audible is emitted such as a quack or a beep or other sound as a reward for an act occurring. This feature is intended to entice children to perform the tooth brushing acts and to keep their toothbrush(es) 122 neatly stored for the next use.

Sound generator 130, within another preferred embodiment of the present invention, may comprise a timing mechanism that may allow an audible call set for a particular time, such as for example, at 7:55 am a pre-recorded sound may announce "toothbrush time" or "good morning" and again at 7:55 pm "toothbrush time" or "good night". Many other sounds may be pre-recorded and it should be appreciate that these listed sounds are by no means limited to the sounds described herein. It should also be noted that other devices such as motion detectors, powering means and other additions may be included within the scope of the present invention.

In addition to the timing mechanism issuing an audible sound, the timing mechanism may also be used as a type of stop watch in order to alert a user brushing his or her teeth when a predetermined time has elapsed since the dispensing of the toothpaste. For example, and not by limitation, a user may use a toothpaste dispensing device to dispense toothpaste onto a toothbrush. When the toothpaste dispensing device is operated, the timing mechanism may then start a timer that is set to a predetermined suggested brushing time, such as two minutes. When the predetermined time has elapsed, an audible alarm may be used to alert the user that brushing can end. In this manner the present invention may also provide a means for controlling the time of tooth brushing episodes thereby promoting oral health.

Reptile eye 202 may be used within the present embodiment to provide an aesthetically pleasing side profile view of toothpaste dispenser 110, as shown in FIG. 2. In this way youngsters shorter in stature may also view and recognize toothpaste dispenser 110 as a means to recollect they should brush their teeth at appropriate intervals.

Toothpaste dispensing system 100 may be sold as a kit 440 comprising the following parts: a toothpaste dispenser 110; a toothbrush 122; a toothpaste tube 120; and a set of user instructions. Toothpaste dispensing system 100 may be manufactured and provided for sale in a wide variety of sizes, shapes and designs for a wide assortment of applications. It should be noted that, under appropriate circumstances, when considering such issues as user, design, and marketing preferences, cost considerations, structural requirements, available materials, technological advances, and the like, other kit contents or arrangements such as, for example, including more or less components, customized parts, different color combinations, matching or non-matching components, parts may be sold separately, and the like, may present a suitable alternative.

Figure 5:
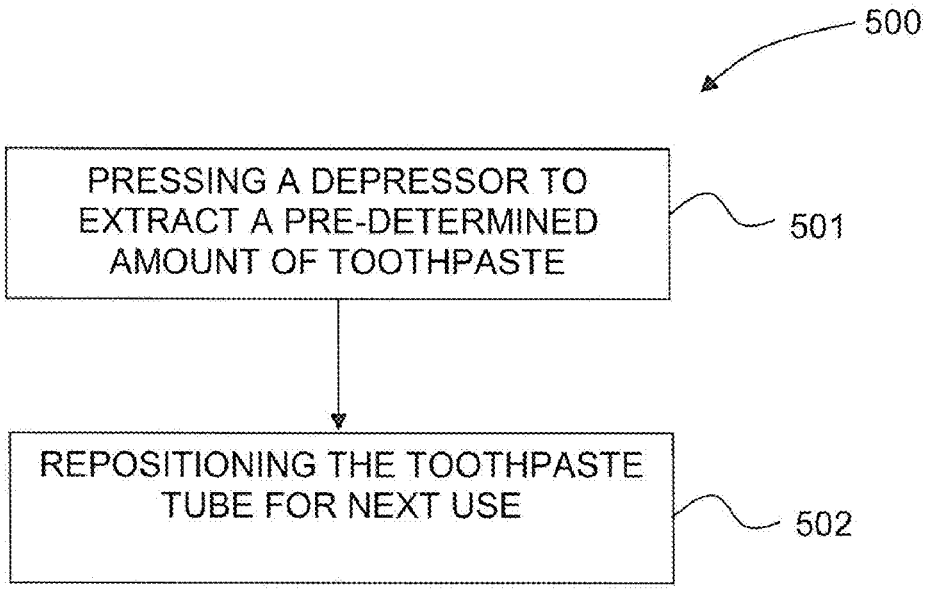
FIG. 5 is a flowchart illustrating a preferred method of use for the toothpaste dispensing system in accordance with the present invention.

Referring now to FIG. 5, showing a flowchart 550, illustrating preferred method of use 500 for toothpaste dispensing system, according to an embodiment of the present invention.

The method of use 500 of a toothpaste dispensing system is disclosed herein comprising the basic steps of: pressing a depressor to extract a pre-determined amount of toothpaste from a toothpaste tube located in a toothpaste dispenser using one hand (Step 501); and repositioning the toothpaste tube for next use (Step 502).

Method 500 may more comprehensively comprise the steps of: inserting toothpaste tube into toothpaste dispenser on a toothpaste tube holder; pressing depressor to extract a pre-determined amount of toothpaste from a toothpaste tube located in a toothpaste dispenser using one hand, wherein the act of pressing depressor activates sound generator; activating sound generator wherein an audible signal is sounded when depressor is depressed against toothpaste tube; using extracted toothpaste to brush teeth of a user; securing a cap to cover an orifice thereby preventing drying of the toothpaste, the securing of the cap causing repositioning of the toothpaste tube for a next use, wherein the toothpaste tube is in contact with gripping means located on the underside of a second coextensive member. It should be noted that optional steps may not be implemented in all cases.

It should also be noted that the steps described in method of use 500 can be carried out in many different orders according to user preference. Those with ordinary skill in the art will appreciate that, under appropriate circumstances, considering such issues as design preference, user preferences, marketing preferences, cost, structural requirements, available materials, technological advances, and the like, other methods of use arrangements such as, for example, different orders within above-mentioned list, elimination or addition of certain steps, including or excluding certain set up and/or intermediate steps, and the like, may work.

From the foregoing description, it should be appreciated that a toothpaste dispensing system embodiment and a method for using toothpaste dispensing system are provided and present significant benefits that would be apparent to one skilled in the art. Furthermore, it should be appreciated that a vast number of variations in the embodiments exist. Lastly, it should be appreciated that these embodiments are exemplary embodiments only, and are not intended to limit the scope, applicability, or configuration of the invention in any way. Rather, the foregoing detailed description provides those skilled in the art with a convenient framework for implementing an exemplary embodiment of the invention. It being understood that various changes may be made in the function and arrangement of elements described in the exemplary embodiment without departing from the spirit and scope of the invention as set forth in the appended claims.

The invention claimed is:

1. A toothpaste dispensing system comprising:

a toothpaste dispenser having a friction surface;

a toothpaste tube holder forming a radius resiliently and integrally securing together a substantially flat first coextensive member and a substantially flat second coextensive member, wherein the radius contains and rolls a portion of a toothpaste tube that has been evacuated of toothpaste, thereby allowing the second coextensive member to remain in contact with a filled portion of the toothpaste tube;

a sound generator, wherein the toothpaste dispenser secures a toothpaste tube on the toothpaste tube holder using the friction surface and the sound generator is used to create at least one audible sound in response to a preset occurrence; and a stopper to create a physical stop between a first coextensive member and a second coextensive member, wherein a pre-determined volume of toothpaste is dispensed in response to a limited travel distance of travel of the depressor determined by the stopper.

2. The toothpaste dispensing system of claim 1, wherein the substantially flat second coextensive member comprises a downward first curvature towards the first coextensive member and an upward second curvature away from the first coextensive member.

3. The toothpaste dispensing system of claim 2, wherein the second coextensive member comprises a depressor.

4. The toothpaste dispensing system of claim 1 wherein the toothpaste dispenser comprises resilient material.

5. The toothpaste dispensing system of claim 1 wherein the toothpaste dispenser comprises a toothbrush holder slot.

6. The toothpaste dispensing system of claim 1, wherein the at least one friction surface comprises backwardly facing teeth functioning as a gripping means.

7. The toothpaste dispensing system of claim 1, wherein the sound generator is used to create at least one audible sound when a depressor is depressed against the toothpaste tube.

8. The toothpaste dispensing system of claim 1, wherein the toothpaste tube holder comprises a concave indentation means to cradle the toothpaste tube.

9. The toothpaste dispensing system of claim 1, wherein the toothpaste tube holder comprises gripping means.

10. The toothpaste dispensing system of claim 1, wherein the toothpaste tube holder comprises an angle of inclination relative to first coextensive member to prevent the toothpaste tube from contacting the first coextensive member.

11. The toothpaste dispensing system of claim 1, further comprising a cap removably secured to the toothpaste tube to cover an orifice thereby preventing drying of the toothpaste.

12. A toothpaste dispensing system comprising:

a toothpaste dispenser having a friction surface, wherein the at least one friction surface comprises backwardly facing teeth functioning as a gripping means;

a toothpaste tube holder forming a radius resiliently and integrally securing together a substantially flat first coextensive member and a substantially flat second coextensive member, wherein the radius contains and rolls a portion of a toothpaste tube that has been evacuated of toothpaste, thereby allowing the second coextensive member to remain in contact with a filled portion of the toothpaste tube; and a sound generator, wherein the toothpaste dispenser secures a toothpaste tube on the toothpaste tube holder using the friction surface and the sound generator is used to create at least one audible sound in response to a preset occurrence.

13. The toothpaste dispensing system of claim 12, wherein the toothpaste dispensing system further comprises a stopper to create a physical stop between a first coextensive member and a second coextensive member, wherein a pre-determined volume of toothpaste is dispensed in response to a limited travel distance of travel of the depressor determined by the stopper.

14. A toothpaste dispensing system comprising:

a toothpaste dispenser having a friction surface;

a toothpaste tube holder forming a radius resiliently and integrally securing together a substantially flat first coextensive member and a substantially flat second coextensive member, wherein the radius contains and rolls a portion of a toothpaste tube that has been evacuated of toothpaste, thereby allowing the second coextensive member to remain in contact with a filled portion of the toothpaste tube; and a sound generator, wherein the toothpaste dispenser secures a toothpaste tube on the toothpaste tube holder using the friction surface and the sound generator is used to create at least one audible sound in response to a preset occurrence, wherein the sound generator is used to create at least one audible sound when a depressor is depressed against the toothpaste tube.

* * * * *